US005597022A

United States Patent [19]

Reifers

[11] Patent Number: 5,597,022

[45] Date of Patent: Jan. 28, 1997

[54] DEVICE FOR LOADING TRASH BAGS

[76] Inventor: Richard F. Reifers, 549 Oenoke Ridge, New Canaan, Conn. 06840

[21] Appl. No.: 530,013

[22] Filed: Sep. 19, 1995

Related U.S. Application Data

[62] Division of Ser. No. 311,106, Sep. 23, 1994, abandoned.

[51] Int. Cl.[6] ..... B65F 1/06

[52] U.S. Cl. ..... 141/390; 141/391; 383/33; 248/99; 220/404; 220/908

[58] Field of Search ..... 383/33; 141/390, 141/391, 316; 248/99; 220/908, 404

[56] References Cited

U.S. PATENT DOCUMENTS

| | | | |
|---|---|---|---|
| 544,585 | 8/1895 | Mayo | 141/390 |
| 2,991,031 | 7/1961 | Sederquist | 141/390 |
| 3,773,286 | 11/1973 | Govoni et al. | 248/99 |
| 3,822,524 | 7/1974 | Jerpbak | 141/390 |
| 3,958,785 | 5/1976 | Aboud | 141/390 |
| 3,983,914 | 10/1976 | Benson | 141/390 |
| 4,014,157 | 3/1977 | Pearce | 141/390 |
| 4,280,676 | 7/1981 | Betts | 141/390 |
| 4,281,813 | 8/1981 | Garrity . | |
| 4,338,979 | 7/1982 | Dow | 220/404 |
| 4,457,483 | 7/1984 | Gagné . | |
| 4,610,039 | 9/1986 | Stern | 141/390 |
| 4,628,007 | 12/1986 | Ledsham . | |
| 4,775,123 | 10/1988 | Borland et al. | 248/99 |
| 4,787,753 | 11/1988 | Barnhart | 383/33 |
| 4,842,228 | 6/1989 | Kasper . | |
| 5,056,679 | 10/1991 | Lonczak . | |
| 5,226,554 | 7/1993 | Dauphinais . | |
| 5,295,606 | 3/1994 | Karwoski . | |

OTHER PUBLICATIONS

Magic Funnel.
Bag Butler.
Super Sweep.

*Primary Examiner*—Stephen J. Castellano
*Attorney, Agent, or Firm*—Watson Cole Stevens Davis, P.L.L.C.

[57] ABSTRACT

A flexible bag is loaded in at least two stages utilizing a loading ring of rigid plastic material having a height less than its diameter and having a height less than approximately one-half the height of the trash bag. The bag is inserted into the loading ring presenting an upper bag section surrounded by the ring section, and is filled with refuse, the lower section of the bag being in a collapsed condition beneath the ring. The ring an upper bag section are then manually shifted upwardly causing the refuse to drop by gravity into the bag lower section, after which the upper bag section is again filled with refuse material, and the loading ring is either removed depending on the bag size, or the loading ring together with the upper bag section is again shifted upwardly to present another unloaded upper bag section which is again filled with refuse. A two-stage or a three-stage loading operation is effected.

3 Claims, 2 Drawing Sheets

DEVICE FOR LOADING TRASH BAGS

This application is a division of application Ser. No. 08/311,106, filed Sep. 23, 1994, now abandoned.

BACKGROUND OF THE INVENTION

This invention relates generally to a method and device for the loading of trash bags, the device comprising a loading ring of a height less than its diameter and of a height approximately less than one-half the height of the trash bag to facilitate loading the bag in at least two loading stages.

Many people attend to their own lawn and gardening chores, investing in lawn and shrub equipment, fertilizers, weed and insect controls to maintain their properties.

Spring and fall clean-ups often require use of trash containers and bags to remove the refuse from the property because tightening pollution controls often prohibit open burning in many communities. Summertime requires continued effort in property maintenance.

Whether the home dweller has his or her garden and lawn refuse hauled away or transported to a local waste disposal area, disposable plastic trash bags are most commonly used.

The flexible trash bags are often times filled by using a trash container usually of rigid plastic material which serves as a rigid outer support container while the bag is being filled. However, such a system is not only inefficient and time consuming but oftentimes requires the use of a second plastic trash bag liner, and adds to the effort involved in lifting the bag out of the trash container when the bag is filled. Moreover, the loading of refuse into a trash bag without the use of a trash container presents many difficulties in loading the bag without spillage or bag rupture or without assistance in holding open the open top of the bag during filling.

The commercially available throw away plastic trash bags for the disposal of refuse are typically constructed in the form of a thin plastic tube having a closed bottom and open top, shipped flat, and rectangular in shape. The bags are either packaged in continuous tear-off rolls or are cut separately and stacked individually in rectangular cardboard containers, and usually include twist ties. Otherwise the bags may be equipped with bag strings.

Placing such a bag into a round or even a square-shaped trash container makes very inefficient use of the volume capacity of the plastic bag used to line the container, in that refuse such as grass clippings and leaves cannot be readily compacted during the loading process, resulting in the bags being consistently left partially filled. Also, it subjects the bag to tearing as rough objects are forced into the can as it is filled. Moreover, the friction between the bag and the container and the negative pressure produced while lifting the bag out of the container renders the bag removal operation most difficult and tedious. Besides, the gardener must lift the filled bag to about six feet above the ground, assuming a bag height of about three feet and a trash container height of the same dimension.

When the bag is finally lifted out of the trash container, the bag expands to its full volume capacity and the gardener finds the bag only a half or two-thirds filled. It becomes difficult to efficiently add refuse to the bag to make use of the unused space except with the assistance of another person to hold the bag open while filling is completed.

SUMMARY OF THE INVENTION

It is an object of the present invention to provide a method and device for the loading of disposable trash bags, whether of flexible plastic or biodegradable paper material, with not only less physical effort, less time and greater convenience, but permitting the bags to be filled to greater capacity with less likelihood of rupture, thereby reducing the waste and cost of using more bags than necessary for a given volume of refuse to be bagged.

The unique advantage of the loading system of the invention is that it utilizes the lower portion of the filled bag as the progressive point of the structure in the bag-filling operation.

The loading device according to the invention is in the form of a lightweight and easy to manipulate loading ring having an endless sidewall of rigid plastic material with an open top and open bottom. The height of the ring is less than its diameter to enhance the stability of the bag during the loading operation, and to improve upon loading ring manipulation during bag loading.

The height of the loading ring is approximately less than one-half the height of the trash bag such that, in use, the bag is loaded to its full capacity in at least two loading stages.

In accordance with the invention the trash bag is inserted within the loading ring and the open top of the bag is overlapped about the open top of the ring such that with the ring resting at its open bottom on the ground or floor, a lower portion of the bag is collapsed under the loading ring while an upper portion of the bag is surrounded by the ring. The overlapping upper top of the bag is anchored to the open top of the loading ring as by the provision of a downwardly turned flange on the ring over which the draped bag is stretched, or by the use of a separate elastic cord or band or a snap ring, depending on the relative size of the bag to be used.

The upper portion of the bag is then initially loaded with a first quantity of material such as grass or shrub clippings, or paper or other refuse if the bag loading method is to be carried out indoors.

Such first quantity of material is then lowered under its own weight into the lower section of the bag by upwardly shifting the loading ring and the upper bag section together to thereby present an upper unloaded bag section surrounded by the loading ring.

Further loading of the upper unloaded section is then carried out for a second quantity of material.

Before the further loading step the open bottom of the loading ring may be depressed into the first quantity of material occupying the lower section to assure stability of the loading ring during the loading operation.

After a two-stage loading operation is completed, assuming the bag height to be approximately twice that of the loading ring height, the loading ring is simply removed by upwardly shifting it out of the bag whereafter the completely filled bag may be tied at its open top as in the normal manner.

For a three-stage loading operation, assuming a bag height of approximately three times the height of the loading ring, after the further loading step, the first and second quantities of material are lowered by gravity into the lower section of the bag by again upwardly shifting the loading ring and the upper bag section together to present a top unloaded bag section surrounded by the loading ring, after which that unloaded bag section is still further loaded with a third quantity of material. The loading ring is then removed from the bag by shifting it upwardly after which the open end of the bag may be simply tied as in the normal manner.

The loading ring may be in the form of a truncated cone with a handle provided adjacent the larger diameter open top, or may be in the form of a truncated cone with a handle provided adjacent the open top at the smaller diameter end. Bag loading may therefore be carried out using separate loading rings with the smaller diameter and/or the larger diameter end facing upwardly. Otherwise, the loading ring in the form of a truncated cone may be provided with handles at opposite open ends to facilitate loading from either end using the same loading ring.

The loading ring according to the invention may be in the form of a straight cylinder having a handle at one open end.

Other objects, advantages and novel features of the invention will become more apparent from the following detailed description of the invention when taken in conjunction with the accompanying drawings.

DETAILED DESCRIPTION OF THE INVENTION

Figure 1:
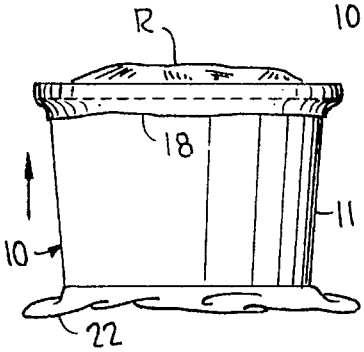
FIG. 1 is a side elevational view of the loading ring of the invention in a first stage of the loading operation with the ring surrounding an upper portion of a trash bag, the ring resting on the ground with a lower section of the bag collapsed thereunder, and with the upper bag section being filled with a first quantity of material.

Turning now to the drawings wherein like reference characters refer to like and corresponding parts throughout the several views, the trash bag loading ring according to the invention is generally designated 10 and comprises an endless sidewall 11 which may be in the form of a truncated cone having an open top 12 and an open bottom 13. The ring may be of a molded rigid plastic material and may have a rim which functions as a handle adjacent its open top which may be in the form of a peripheral flange 14 having a depending lip 15, similar to that of a standard trash container at its open upper end. Otherwise, or in addition to such a handle, the loading ring may be provided with one or more elongated cutouts 16 (see FIG. 9) which may serve as a handle or as a means for hooking the loading ring onto a nail or bracket during storage.

Figure 8:
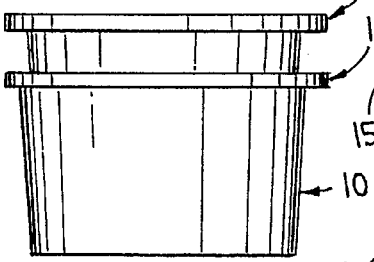
FIG. 8 is a side elevational view of a plurality of FIG. 7 loading rings nested together during storage.

The conical configuration of the loading ring lends itself to the nesting of one loading ring into another, as shown in FIG. 8, during storage and shipment. Otherwise, the loading ring may be of straight cylindrical form having an open top and open bottom, such as that generally designated 17 in FIG. 9. Loading ring 17 is otherwise the same as loading ring 10 in structure and function, and loading ring 10 and/or 17 may have a rounded sidewall 11 as shown or may have a multi-sided wall 11 such as hexagonal, octagonal or the like, without departing from the invention.

Figure 4:
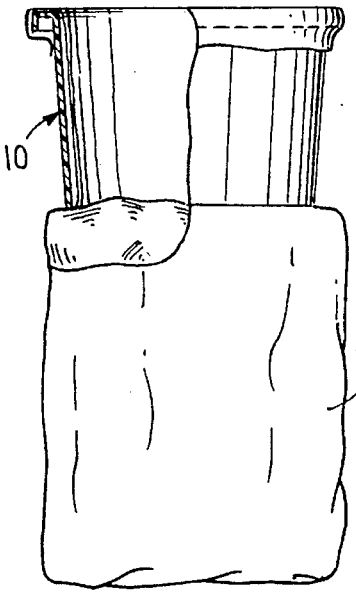
FIG. 4 is a view similar to FIG. 2 showing the third stage of the loading operation in which the loading ring, shown party in section, and the upper bag section are shifted upwardly presenting another unloaded upper bag section.
Figure 5:
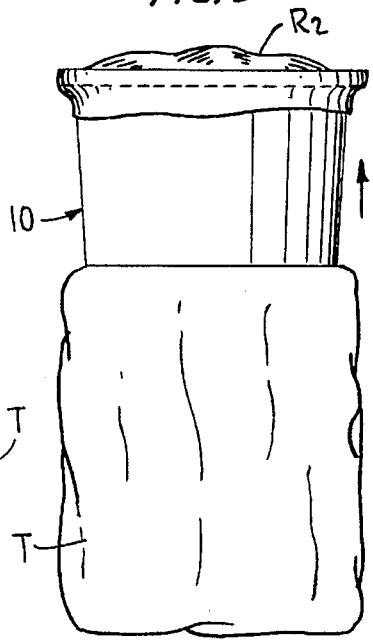
FIG. 5 is a view similar to FIG. 3 showing the unloaded upper bag section loaded with a third quantity of material.
Figure 6:
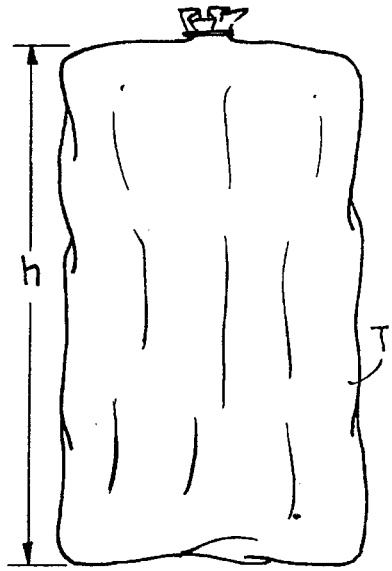
FIG. 6 is a side elevational view of a completely filled trash bag tied at its open top upon completion of a three-stage loading operation.
Figure 7:
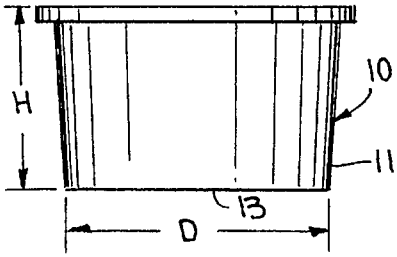
FIG. 7 is a side elevational view of the loading ring according to one embodiment of the invention.

Loading ring 10 has a height H slightly less than its diameter D of open bottom 13 (FIG. 7), and loading ring 17 similarly has a height H slightly less than its diameter D (FIG. 7). And, the height H of loading ring 10 and loading ring 17 is slightly less than one-half the height of trash bag T (FIGS 4 to 6). The bag is shown completely filled with refuse, although its nominal height h unfilled is approximately the same as that in its filled condition.

In accordance with the invention, the trash bag T, which is a flexible bag of plastic or biodegradable material, having an open top and closed bottom and having a capacity of about 30 to 55 gallons, is inserted into loading ring 11 such that open top 18 of the bag is wrapped over the open top 12 of the loading ring to overlie flange 14 and depending lip 15, as shown. Depending on the relative diametral size of the bag to that of the loading ring the open end of the bag is anchored in place about the upper open end of the loading ring by stretching the bag over flange 14 and its lip 15 to thereby present a peripheral cuff 19 about the ring's open top. An elastic cord or band 21 on a snap ring (not shown) engaging flange 14 may be provided to surround cuff 19 to removably secure the open top of the bag to open top 12 of the loading ring especially when a partially loaded bag with its loading ring needs to be moved from location to location during the loading process.

In FIG. 1 an upper section of the bag is shown surrounded by the loading ring with a lower section 22 of the bag collapsed beneath the loading ring as the ring rests at its open bottom on the ground if the loading operation is performed outdoors, or on the floor if the loading operation is performed indoors. The upper section of the bag is then loaded with refuse R such as yard or lawn clippings or scrap paper or the like and, because of the relatively low height of the loading ring, the refuse may easily be compacted by the loading operator using, for example, the hands or feet. Also, the loading ring permits the refuse to be compacted without spillage or bag rupture, and avoids tears of the bag caused by twigs or the like. FIG. 1 represents stage one of the loading operation according to the invention.

Figure 2:
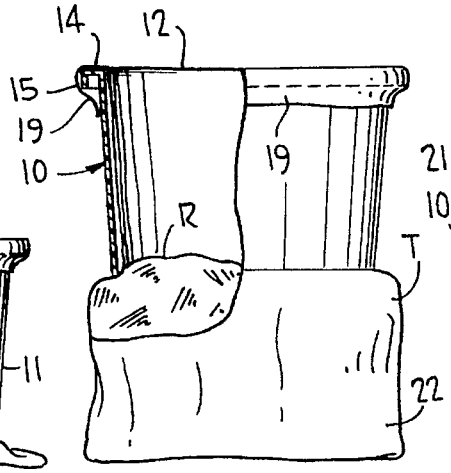
FIG. 2 is a view similar to FIG. 1 showing the second stage of the loading operation in which the loading ring, shown partly in section, and upper bag section are shifted upwardly presenting an unloaded upper bag section.
Figure 3:
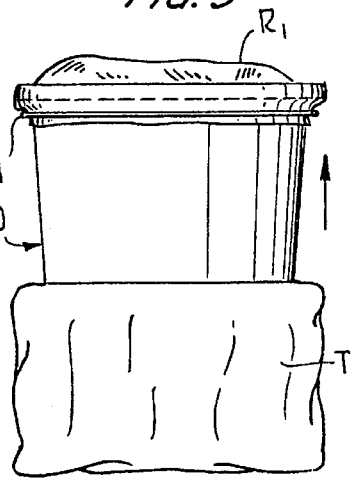
FIG. 3 is a view similar to FIG. 2 showing the unloaded upper bag position filled with a second quantity of material.

In stage two of the loading operation, the loading ring together with the upper section 20 of the bag are manually shifted as by lifting upwardly by the operator, allowing the refuse to fall by gravity into lower section 22 of the bag shown in FIG. 2. The upper bag section, seen in FIG. 2 as now unloaded, presents an upper unloaded bag section surrounded by the loading ring, which ring may be pressed into the partially filled bag for stabilizing the loading ring in place. The upper unloaded bag section of FIG. 2 is then filled with additional refuse $R_1$ shown in FIG. 3 and may be compacted as before without spillage or bag rupture.

If the bag height h is approximately twice that of the height H of the loading ring, the loading ring may be simply removed by lifting it away from the bag after which the open top of the bag is tied or closed in the normal manner.

If the bag height h is greater than twice the height H of the loading ring, such as a height of about three times the height of the ring, the loading ring together with the upper section of the bag are again shifted upwardly as by manual lifting, as shown in FIG. 4, into stage three of the loading operation. During this process refuse quantity $R_1$ falls by gravity to overlie refuse quantity R into the lower section of the bag, and the open bottom of the loading ring can be pressed into the partially filled bag for stability of the ring.

The upper unloaded bag section surrounded by the ring shown in FIG. 4 is then still further filled with refuse $R_2$, as shown in FIG. 5, and may be compacted as before as part of stage three of the loading operation. Thereafter the loading ring is removed by lifting it off the bag, and the completely loaded bag shown in FIG. 6 may be tied or otherwise closed at its open top in the normal manner.

Figure 9:
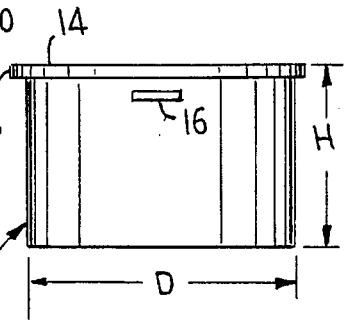
FIG. 9 is a side elevational view of another embodiment of a loading ring according to the invention.

As described earlier the loading ring need not be of truncated conical shape but can be of a straight cylindrical shape, shown in FIG. 9, which operates in an identical manner to that described above for a bag loading operation.

Figure 10:
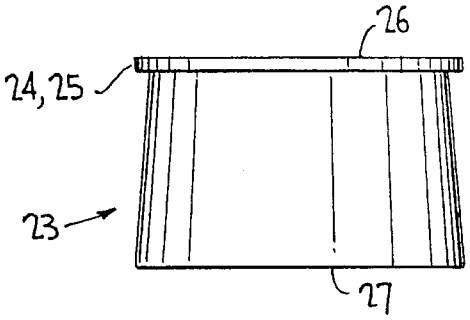
FIG. 10 is a side elevational view of yet another embodiment of a loading ring according to the invention.

Loading ring 23 of FIG. 10 is similar to loading ring 10 in that it is in the shape of a truncated cone, except that ring 23 is designed for use in an inverted position compared to that of ring 10. Thus, handle means which may be in the form of a flange 24, with or without a depending lip 25, is provided adjacent open top 26 which is of smaller diameter compared to that of open bottom 27. The loading ring may be used in the same manner according to the invention described above for trash bags of smaller diameter and with a correspondingly smaller open end compared to the size of the trash bag when loaded using loading rings or 10 or 17. Loading ring 23 may be fabricated using the same tooling as when fabricating ring 10 except that flange 24 with or without a depending lip 25, is provided at the smaller open end.

Figure 11:
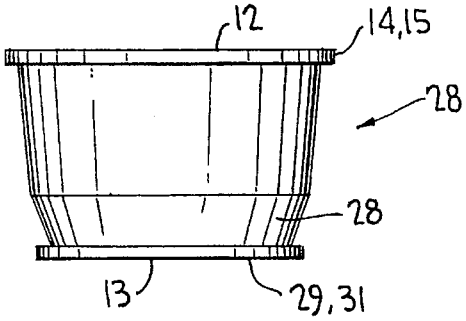
FIG. 11 is a side elevational view of a still further embodiment of a loading ring according to the invention.

Loading ring 28 of FIG. 11 is similar to loading ring 10 being in the form of a truncated cone having a peripheral flange 14, and an optional depending lip 15, provided adjacent open top 12 for use of the handle means when carrying out the loading system of the invention as described with reference to FIGS. 1 to 5.

Loading ring 28, however, is likewise capable of use in an inverted position with its open bottom facing upwardly, i.e., for loading a trash bag as would be loaded using loading ring 23. Handle means in the form of a flange 29, with an optional lip 31 facing handle 14, 15, may be provided adjacent opening 13. The smaller diameter end 13 compared to that of end 12 of ring 28 facilitates use of the loading ring in either an upright or an inverted position with trash bags of different sizes without the need to provide two separate loading rings of correspondingly different sizes.

Ring 28 may be nested within like rings 28 and, for this purpose, a lower section **28*a* of the ring sidewall is angled inwardly at the bottom to a greater extent as shown such that flange 29** is maintained inside the primary nesting angle to facilitate stacking.

The provision of peripheral flanges at opposite open ends of ring 28 renders it more rigid and more stable, and effectively combines loading rings 10 and 23 into one. Loading ring 28 may be used in either its upright or inverted position in carrying out the loading system of the invention in the same manner as described with reference to loading ring 10.

Each of the loading rings according to the invention can be used in loading over-sized trash bags according to the system of the invention by securing the open end of the bag over the open top of the loading ring using an elastic band 21, a chord, or the like.

Because of the rather shallow height of the loading ring, it can be easily manipulated due to its light weight without the need for lifting a fully loaded bag out of a fully sized trash container as before. The loading ring allows the refuse to be compacted, avoids spillage and bag rupture, can be easily stored and is readily removable from the bag without offering friction resistance as in prior art loading operations. And, the trash bag according to the loading operation of the invention is capable of being more completely filled compared to using known methods thereby making more efficient and economic use of the trash bags.

The loading system of the invention is unique in that the partially filled bag during a two-stage or three-stage loading operation serves as an effective progressive part of the structure in the bag loading system.

Obviously many other modifications and variations of the present invention are made possible in light of the above teachings. It is therefore to be understood that within the scope of the appended claims the invention may be practiced otherwise than as specifically described.

What is claimed is:

1. A device for loading a flexible trash bag with compactible refuse including leaves, lawn clippings, and scrap paper, comprising, in combination:

a loading ring comprising a continuous and uninterrupted sidewall forming a truncated cone having an open upper end of a given diameter and an open lower end of a diameter less than said given diameter;

said lower end presenting a continuous, annular edge at which said ring is supported in an upstanding position;

said ring being of one-piece rigid material having outwardly extending handle means at said upper end;

said trash bag having a capacity of about 30 to 55 gallons and said sidewall having a height slightly less than said diameter of said open lower annular edge;

said bag having a sidewall of a given diameter and height, an open top end and a closed bottom end, said diameter of said bag sidewall being greater than the diameter of said lower annular edge;

said sidewall height of said ring being slightly less than one-half the height of said bag;

said open top of said bag being secured about said handle means, and said bag sidewall extending within said ring from said upper end thereof to at least said annular edge when said bag is collapsed in a first empty condition prior to loading;

said ring being supported at said annular edge on the surface of the ground or a floor in said first condition, and said ring sidewall forming a first enclosure for refuse in said first condition; and said bag sidewall extending beyond said annular edge when the bag is partially filled or completely filled with refuse in a second filled condition;

said ring being supported at said annular edge directly on the bag in said second condition for both compacting the refuse upon application of a downward manual external force to said ring and for forming a second enclosure for refuse in said second condition.

2. The device according to claim 1, further comprising an elastic band for further securing said open top of said bag about said handle means.

3. The device according to claim 1, wherein said handle means comprises an external, peripheral, cupped flange.

* * * * *